US006069124A

United States Patent [19]

Appel et al.

[11] Patent Number: 6,069,124

[45] Date of Patent: May 30, 2000

[54] GRANULAR DETERGENT COMPOSITIONS AND THEIR PRODUCTION

[75] Inventors: Peter Willem Appel; Marcel van der Kraan, both of Vlaardingen, Netherlands

[73] Assignee: Lever Brothers Company Division of Conopco, Inc., New York, N.Y.

[21] Appl. No.: 09/085,071

[22] Filed: May 26, 1998

[30] Foreign Application Priority Data

May 30, 1997 [GB] United Kingdom ..... 9711350

[51] Int. Cl.[7] ..... C11D 17/00

[52] U.S. Cl. ..... 510/438; 510/443; 510/444; 510/452; 510/509

[58] Field of Search ..... 510/438, 444, 510/443, 452, 509

[56] References Cited

U.S. PATENT DOCUMENTS

| | | | |
|---|---|---|---|
| 4,524,010 | 6/1985 | Reuter et al. | 252/135 |
| 4,639,326 | 1/1987 | Czempik et al. | 252/91 |
| 4,828,721 | 5/1989 | Bollier | 252/8.7 |
| 4,923,628 | 5/1990 | Appel et al. | 252/135 |
| 5,002,682 | 3/1991 | Bragg et al. | 510/311 |
| 5,569,645 | 10/1996 | Dinniwell et al. | 510/276 |
| 5,726,142 | 3/1998 | Partee et al. | 510/276 |

FOREIGN PATENT DOCUMENTS

| | | |
|---|---|---|
| 1070210 | 1/1980 | Canada . |
| 164 514 | 12/1985 | European Pat. Off. . |
| 168 102 | 1/1986 | European Pat. Off. . |
| 220 024 | 4/1987 | European Pat. Off. . |
| 221 776 | 5/1987 | European Pat. Off. . |
| 242 138 | 10/1987 | European Pat. Off. . |
| 266 863 | 5/1988 | European Pat. Off. . |
| 289 311 | 11/1988 | European Pat. Off. . |
| 289 312 | 11/1988 | European Pat. Off. . |
| 289 313 | 11/1988 | European Pat. Off. . |
| 341 072 | 11/1989 | European Pat. Off. . |
| 342 043 | 11/1989 | European Pat. Off. . |
| 351 937 | 1/1990 | European Pat. Off. . |
| 228 011 | 4/1990 | European Pat. Off. . |
| 367 339 | 5/1990 | European Pat. Off. . |
| 384 070 | 8/1990 | European Pat. Off. . |
| 390 251 | 10/1990 | European Pat. Off. . |
| 390 287 | 10/1990 | European Pat. Off. . |
| 420 317 | 4/1991 | European Pat. Off. . |
| 425 277 | 5/1991 | European Pat. Off. . |
| 430 328 | 6/1991 | European Pat. Off. . |
| 451 894 | 10/1991 | European Pat. Off. . |
| 477 974 | 4/1992 | European Pat. Off. . |
| 534 525 | 9/1992 | European Pat. Off. . |
| 521 635 | 1/1993 | European Pat. Off. . |
| 550 086 | 7/1993 | European Pat. Off. . |
| 560 395 | 9/1993 | European Pat. Off. . |
| 562 628 | 9/1993 | European Pat. Off. . |
| 593 014 | 4/1994 | European Pat. Off. . |
| 618 290 | 5/1994 | European Pat. Off. . |
| 639 637 | 2/1995 | European Pat. Off. . |
| 639 639 | 2/1995 | European Pat. Off. . |
| 643 130 | 3/1995 | European Pat. Off. . |
| 653 481 | 5/1995 | European Pat. Off. . |
| 2 356 718 | 1/1978 | France . |
| 2 050 560 | 4/1971 | Germany . |
| 8-027498 | 1/1996 | Japan . |
| 1303479 | 1/1973 | United Kingdom . |
| 1 470 250 | 4/1977 | United Kingdom . |
| 1 473 202 | 5/1977 | United Kingdom . |
| 2 123 044 | 1/1984 | United Kingdom . |
| 2 301 835 | 12/1996 | United Kingdom . |
| 2 304 726 | 3/1997 | United Kingdom . |
| 92/07060 | 4/1992 | WIPO . |
| 93/02168 | 2/1993 | WIPO . |
| 93/18124 | 9/1993 | WIPO . |
| 93/20172 | 10/1993 | WIPO . |
| 94/01521 | 1/1994 | WIPO . |
| 995/02682 | 1/1995 | WIPO . |
| 96/34084 | 10/1995 | WIPO . |
| 96/096917 | 3/1996 | WIPO . |
| 96/806916 | 3/1996 | WIPO . |
| 96/10070 | 4/1996 | WIPO . |
| 96/22355 | 7/1996 | WIPO . |
| 96/37599 | 11/1996 | WIPO . |
| 96/38529 | 12/1996 | WIPO . |
| 96/38530 | 12/1996 | WIPO . |
| 97/32002 | 9/1997 | WIPO . |
| 97/32005 | 9/1997 | WIPO . |

OTHER PUBLICATIONS

Derwent abstract of JP 09 095694 dated Apr. 8, 1997.
Derwent abstract of JP 03084100 dated Apr. 9, 1991.
Derwent abstract of JP 08027498 dated Jan. 30, 1996.
Derwent abstract of JP 8027498 dated Jan. 30, 1996.
Derwent abstract of JP 7268398 dated Oct. 17, 1995.
Derwent abstract of JP 7197084 dated Aug. 1, 1995.
Derwent abstract JP 617892 dated Jun. 28, 1994.
Derwent abstract of DE 3131668 (with Miyazaki et al., U.S. 4,405,484) dated Mar. 11, 1982.
Derwent abstract of PCT patent application WO 96/23864 dated Aug. 8, 1996.
Derwent abstract of European patent application EP 219 328 dated Apr. 22, 1987.
Derwent abstract of European patent application EP 168 102 dated Jan. 15, 1986.
Derwent abstract of German patent application DE 4229660 dated Mar. 10, 1994.

(List continued on next page.)

*Primary Examiner*—Lorna M. Douyon
*Attorney, Agent, or Firm*—Rimma Mitelman

[57] ABSTRACT

A detergent composition having a bulk density of at least 550 kg/m$^3$ comprises a mixture of:

(a) a granulate, preferably a mechanically mixed granulate, of bulk density 450 kg/m$^3$ to 1300 kg/m$^3$, comprising surfactant and inorganic material, and (b) a spray-dried adjunct comprising inorganic material, preferably sodium sesquicarbonate or Burkeite, component (a) being present in an amount of from 35% to 85% by weight of the total granular product.

The adjunct allows the bulk density of the final composition to be adjusted to any chosen value without detriment to other properties, thus providing flexibility to formulate at a range of bulk densities.

8 Claims, No Drawings

OTHER PUBLICATIONS

Derwent abstract of German patent application DE 3545947 dated Jul. 2, 1987.
Derwent abstract of German patent application DE 3424299 dated Jan. 9, 1986.
Derwent abstract of German patent application DE 19601841 dated Jul. 24, 1997.
Derwent abstract of Japanese patent application JP 4363400 dated Dec. 16, 1992.
Derwent abstract of Japanese patent application JP 7011293 dated Jan. 13, 1995.
Derwent abstract of Japanese patent application JP 7286195 dated Oct. 31, 1995.
Derwent abstract of Japanese patent application JP 7286196 dated Oct. 31, 1995.
Derwent abstract of Japanese patent application JP 7286197 dated Oct. 31, 1995.
Derwent abstract of Japanese patent application JP 7286198 dated Oct. 31, 1995.
Derwent abstract of Japanese patent application JP 7258693 dated Oct. 9, 1995.
Derwent abstract of Japanese patent application JP 7268397 dated Oct. 17, 1995.
Derwent abstract of Japanese patent application JP 7268399 dated Oct. 17, 1995.
Derwent abstract of Japanese patent application JP 7268400 dated Oct. 17, 1995.
Derwent abstract of Japanese patent application JP 8003600 dated Jan. 9, 1996.

GRANULAR DETERGENT COMPOSITIONS AND THEIR PRODUCTION

TECHNICAL FIELD

The present invention relates to detergent particles and a process for their production.

In particular the present invention relates to a granular detergent composition comprising a mixture of a granulate, especially a mechanically mixed granulate, and a spray-dried adjunct.

BACKGROUND

Generally speaking, there are two main types of processes by which detergent powders can be prepared. The first type of process involves spray-drying an aqueous detergent slurry in a spray-drying tower. This process may include the additional step of spraying a surfactant onto a spray-dried base powder. In the second type of process the various solid components are mechanically mixed and optionally agglomerated with liquids, eg nonionic surfactants. The latter kind of process is suited to the production of powders having a relatively high bulk density. However for spray-dried powders postdosed ingredients may be added so that the final bulk density of the product is raised.

Spray-drying is only suited to production of low-to-medium bulk density products because the chemical composition of the slurry used in the spray drying process markedly affects the bulk density of the granular product. This bulk density can only be significantly increased by increasing the content of relatively dense sodium sulphate and/or sodium carbonate. However, sodium sulphate does not contribute to detergency, so that the overall performance of the powder in the wash is thereby reduced.

In some cases, the production of products by mechanical mixing has been described, using a solid starting material which itself has been produced by spray-drying. Obviously, the resultant product will then also contain sodium sulphate.

For a given target bulk density, often the ranges of amounts of surfactants, builders and other ingredients in the detergent granules are limited by the conditions of the particular process in question. This is especially (but not exclusively), the case for producing detergent products having bulk densities spanning the interface between medium and high bulk densities. Further restrictions on formulation flexibility then arise if one tries to minimise the content of non-functional ingredients such as sodium sulphate in the detergent compositions. Obviously such problems are undesirable in the formulation of detergent products.

It is already known to post-dose relatively low amounts of adjuncts of minor ingredients in the form of mechanically mixed granules or spray-dried granules, to a spray-dried detergent powder in order to produce a finished granular detergent composition. For example enzymes, antifoams, or other minor ingredients may be added to spray-dried detergent powders in the form of prills, marumes or granules.

Conventionally, the bulk of the prill, marume or granule is typically formed from ingredients which have no function in the detergent product but which simply act as a filler, for example, sodium sulphate.

In some cases the addition of post-dosed additives in detergent products can lead to a deterioration in the properties of the powders. In particular the dispensing properties and physical properties such as the dynamic flow rate (DFR) may suffer.

It can thus be appreciated that control of the bulk density of a product, whilst retaining formulation flexibility and product characteristics (such as the product's flow or dispensing properties) is a problem; replacing high bulk density components with lower bulk density ones may lead to a worsening of such properties or lower bulk destiny products may not exhibit the same physical properties as their higher bulk density counterparts.

The flow properties of particulate compositions can be measured, for example, by the dynamic flow rate (DFR).

The present invention seeks to address the aforementioned problems by utilising a mixture of granules (in particular granules which have been produced by mechanical mixing) and particles which have been produced by spray-drying. The present invention seeks to provide detergent products having a high degree of formulation flexibility but which retain the desired bulk density range and physical properties eg dispensing properties and dynamic flow rate of the products.

Furthermore the products are especially energy efficient to produce when the granulate is produced by a mechanically mixed method.

PRIOR ART

EP 242 138A (Unilever) discloses particulate detergent compositions containing spray-dried carbonate-containing detergent base powders with a bulk density of 500–550 g/l; the base powders are prepared by a spray-drying process in which an acid (eg succinic acid, fatty acid, polyacrylic acid) is reacted with sodium carbonate in the slurry to produce sodium sesquicarbonate.

EP 221 776A, EP 289 311A and EP 289 312A (Unilever) disclose granular spray-dried detergent compositions comprising a crystal-growth-modified carbonate-based structurant salt, such as sodium sesquicarbonate or Burkeite. The use of these salts as carriers for fabric softening compounds is disclosed in EP 289 313A (Unilever).

EP 266 863A (Unilever) discloses sodium-carbonate-based particulate antifoam ingredients, suitable for incorporation into powder detergent products. The carrier for the antifoam ingredient may be a crystal-growth-modified salt such as Burkeite.

DEFINITION OF THE INVENTION

The present invention accordingly provides a granular detergent composition having a bulk density of at least 550 kg/$^3$ which comprises a mixture of:

(a) a granulate having a bulk density of from 450 kg/m$^3$ to 1300 kg/m$^3$ which comprises from 15 to 50% by weight of synthetic surfactant material and from 30 to 80% by weight of inorganic material based upon the total weight of the granulate; and (b) a spray-dried adjunct comprising from 0 to 35% by weight of synthetic surfactant material and from 45 to 95% by weight of inorganic material based upon the total weight of the adjunct;

wherein component (a) is present in an amount of from 35% to 85% by weight of the total granular product.

DETAILED DESCRIPTION OF THE INVENTION

The Granulate (a) (base powder)

The granulate (a) comprises from 15 to 50% by weight, preferably from 20 to 40% by weight, of synthetic surfactant material based on the total weight of the granulate. Suitable synthetic surfactant materials are described below.

The granulate further comprises from 30 to 80% by weight, preferably from 35 to 75% by weight, of inorganic material based on the total weight of the granulate. It is especially preferred that the inorganic material comprises a builder which may be either a phosphorus-based builder or a non-phosphorus-based builder.

The granulate may optionally further comprise small amounts of components conventionally included in detergent base powders, for example, builder or structurant polymers, other supplementary builders, fluorescers, or anti-redeposition polymers. Typically the amount of these conventional components does not exceed 20% by weight of the total weight of the granulate.

Usually the granulate comprises from 0.5 to 10% by weight of water, more usually from 1 to 8% by weight, based on the total weight of the granulate.

The bulk density of the granulate is within the range of from 450 to 1300 kg/m$^3$, preferably within the range of from 500 to 1200 kg/m$^3$, most preferably from 550 to 1100 kg/m$^3$, for example, from 600 kg/m$^3$ to 900 kg/m$^3$.

The granulate is preferably present in an amount of from 45 to 80% by weight, based on the total weight of the granular detergent composition.

The granulate preferably has an average particle diameter of from 250 mm to 1000 mm, more preferably from 400 mm to 800 mm. The spray-dried adjunct preferably has an average particle diameter of from 100 mm to 900 mm, more preferably from 300 mm to 700 mm. Unless stated specifically to the contrary, all average particle diameters are $d_{50}$ average particle diameters.

Preferably the granulate is prepared by a mechanical mixing process, such as granulation or agglomeration, rather than by spray-drying. However, the invention also encompasses spray-dried granulates, and granulates prepared initially by spray-drying and then granulated and/or densified.

The porosity of the granulate, when mechanically mixed, is preferably from 0 to 20, more preferably from 0 to 10. The porosity of the granulate when produced by spray drying will typically be greater than when the granulate is produced by mechanical mixing. The porosity of the spray-dried adjunct is preferably from 30 to 80, more preferably from 35 to 70.

The measurement of particle porosity is based on the well known Kozeny-Carman relation (equation I) for air flow through a packed bed of powder:

$$\frac{\phi_v h}{\Delta P} = k\frac{\pi D_{bed}^2}{4\eta} D_p^2 \frac{\varepsilon_{bed}^3}{(1-\varepsilon_{bed})^2} \quad \text{in which:} \tag{I}$$

$\phi_v$ = air flow $\Delta P$ = pressure drop over the bed $D_{bed}$ = bed diameter $h$ = bed height $D_p$ = particle diameter $\varepsilon_{bed}$ = bed porosity $\eta$ = gas viscosity $k$ = empirical constant, equal to 180 for granular solids The bulk density of a powder can be described by the following equation (equation II):

$$\text{Bulk density} = \rho_{sol}\cdot(1-\epsilon_{bed})\cdot(1-\epsilon_{particle}) \tag{II}$$

in which:

$\rho_{sol}$=solids density of the materials in the particle $\epsilon_{particle}$=particle porosity Based on these equations, the particle porosity can be derived from the following experiments:

A glass tube with a diameter of 16.3 mm, containing a glass filter (pore diameter 40–90 $\mu$m) as support for the powder, is filled with a known amount of powder (particle size between 355 and 710 $\mu$m). The height of the powder bed is recorded. An airflow of 375 cm$^3$/min is flowed through the bed of powder. The pressure drop over the bed is measured. The pressure drop over the empty tube should also be measured at the specified air flow.

This measurement is repeated with the same quantity of powder, but now a more dense bed packing is achieved by gentle tapping of the tube containing the powder. Again the pressure drop is measured at the specified air flow.

In order to be able to derive the particle porosity from these measurements, also the solids density of the particles is needed (equation II). This is measured using helium pycnometry, eg by using a penta pycnometer supplied by Quantachrome.

Based on the above described measurements and equations, the particle porosity can easily be derived.

Preparation of the Granulate (a)

The granulate may be produced by any suitable process, in particular by any mechanical mixing process known in the art, either continuous or batch-wise. The following paragraphs refer to the preparation of such a mechanically mixed granulate which is a preferred embodiment of the invention.

However, the present invention is not to be construed as limited thereto and the granulate may also be prepared by any suitable spray drying process, optionally followed by densification and/or granulation. Spray dried granulates are also within the scope of the present invention and may be prepared by any suitable process known in the art.

The granulate may be a mechanically mixed granulate, for example, produced by a process in which the starting materials are mixed in a high speed mixer and then maintained or brought into a deformable state in a moderate speed mixer/densifier, before cooling and/or drying. This process is described in EP 367 339A (Unilever). Preferably, this process is performed continuously with a mean residence time in the high speed mixer of from about 5 to 30 seconds and a residence time in the moderate speed mixer densifier of from 1 to 10, preferably from 2 to 5 minutes. Actually, in some cases, the second stage in the moderate speed mixer/densifier is optional.

In the first mixing step, the solid components of the feedstock are very thoroughly mixed with the liquid blend by means of a high-speed mixer. Such a mixer provides a high energy stirring input and achieves thorough mixing in a very short time.

As high-speed mixer the Lodige (Trade Mark) CB 30 Recycler may be used. This apparatus essentially consists of a large, static hollow cylinder having a diameter of about 30 cm which is horizontally placed. In the middle, it has a rotating shaft with several different types of blades mounted thereon. It can be rotated at speeds between 100 and 2500 rpm, dependent on the degree of densification and the particle size desired. The blades on the shaft provide a thorough mixing action of the solids and the liquids which may be admixed at this stage. The mean residence time is somewhat dependent on the rotational speed of the shaft, the position of the blades and the weir at the exit opening.

Other types of high-speed mixers/densifiers having a comparable effect on detergent powders can also be contemplated. For instance, a Shugi (Trade Mark) Granulator or a Drais (Trade Mark) K-TTP 80 may be used.

In the first mixing step, the components of the feedstock are thoroughly mixed in a high-speed mixer/densifier for a relatively short time of about 5–30 seconds, preferably under conditions whereby the starting material is brought into, or maintained in, a deformable state, to be defined hereafter.

In the case of production of highest bulk density granules, after the first mixing step, if the resultant detergent material still possesses a considerable porosity, then instead of choosing a longer residence time in the high-speed mixer/densifier to obtain a further bulk density increase, it may then be subjected to the optional second mixing step in which the detergent material is treated in a moderate-speed granulator/densifier. During this second processing step, the conditions are such that the powder is brought into, or maintained in, a deformable state. As a consequence, the particle porosity will be further reduced. The main differences with the first step reside in the lower mixing speed and the longer residence time of 1–10 minutes, and the necessity for the powder to be deformable.

The optional second mixing step can be successfully carried out in a Lödige (Trade Mark) KM 300 mixer, also referred to as Lödige Ploughshare. This apparatus essentially consists of a hollow static cylinder having a rotating shaft in the middle. On this shaft various plough-shaped blades are mounted. It can be rotated at a speed of 40–160 rpm. Optionally, one or more high-speed cutters can be used to prevent excessive agglomeration. Another suitable machine for this step is, for example the Drais (Trade Mark) K-T 160.

For use, handling and storage, the densified detergent powder must be in a free flowing state. Therefore, in a final step the powder can be dried and/or cooled if necessary. This step can be carried out in a known manner, for instance in a fluid bed apparatus (drying, cooling) or in an airlift (cooling). It is advantageous if the powder needs a cooling step only, because the required equipment is relatively simple and more economical.

For production of high bulk density products, any optional second mixing step and preferably also for the first mixing step, the detergent powder should be brought into a deformable state in order to get optimal densification. The high-speed mixer and/or the moderate speed granulator/densifier are then able to effectively deform the particulate material in such a way that the particle porosity is considerably reduced or kept at a low level, and consequently the bulk density is increased.

To improve granulation and flow properties, this process may employ dosing of a layering agent in the moderate speed mixer/densifier, as described in EP 390 251A (Unilever).

Where the granulate contains an anionic surfactant, advantageously, this is formed by dry neutralisation of a liquid acid precursor of the anionic surfactant with a water-soluble alkaline inorganic material in the high speed mixer, as described in EP 420 317A (Unilever).

Alternatively, anionic surfactant may be produced in the mechanically mixed granules by a wet neutralisation process which comprises contacting a pumpable precursor acid of the anionic surfactant with a pumpable neutralising agent in a drying zone to produce the anionic surfactant, (the total water content preferably being in excess of 10% and more preferably in excess of 20% by weight), agitating the precursor and neutralising agent with agitation means (preferably having a tip speed in excess of 15 $ms^{-1}$ and more preferably in excess of 20 $ms^{-1}$), heating the surfactant (preferably to a temperature in excess of 130° C. and more preferably in excess of 140° C.) in the drying zone to reduce the water content (preferably to not more than 20% by weight and more preferably not more than 15% by weight) and subsequently cooling the surfactant to form the granulate. In a continuous process of the latter kind, the flow rate is suitably of the order of 10 to 25 $kg/m^2/hr$ and preferably 17 to 22 $kg/m^2/hr$, eg 20 $kg/m^2/hr$.

Suitably the average residence time in the drying zone is less than 5 minutes. A residence time of less than 4 minutes is especially preferred with as low a residence time as possible being most preferred.

Agitation of the precursor and neutralising agent (hereinafter referred to as the feedstocks) in the heating zone generally provides efficient heat transfer and facilitate removal of water. Agitation reduces the contact time between the feedstocks and the wall of the drying zone which, together with efficient heat transfer, reduces the likelihood of 'hot spots' forming which may lead to thermal decomposition. Moreover, improved drying is secured thus allowing a shorter residence time/increased throughput in the drying zone.

To avoid thermal decomposition, the temperature of the drying zone preferably does not exceed 170° C.

The above process permits the formation of particles having a bulk density for example in excess of 550 $kg/m^3$. The material is cooled in a cooling zone which is suitably operated at a temperature not in excess of 50° C. and preferably not in excess of 40° C., eg 30° C. Desirably there is agitation within the cooling zone to provide efficient cooling of the material therein. By actively cooling the particles, the possibility of thermal decomposition occurring due to the particles being heated to a high temperature is reduced.

In addition to the precursor acid and neutralising agent feedstocks, pre-neutralised surfactants eg primary alcohol sulphate (PAS), linear alkylbenzene sulphonate (LAS) and alkyl ether sulphate (LES) may be fed into the drying zone as a separate feedstock and/or as an admixture with the neutralising agent and/or the precursor acid.

The above process may be carried out in any suitable apparatus however it is preferred that a flash reactor is employed. Suitable flash reactors include, for example, the Flash Drier system available from VRV SpA Impianti Industriali. The drying zone may have a heat transfer area of at least 10 $m^2$. The cooling zone desirably has a heat transfer area of at least 5 $m^2$.

Optionally two or more drying zones may be employed before the cooling zone as desired. A single apparatus may be employed to provide the drying zone and cooling zone as desired or alternatively separate apparatus for example a drier and a cooling fluid bed may be employed.

Suitably the drying zone is substantially circular in cross section and is thus defined by a cylindrical wall.

Preferably the said wall is heated by means of a heating jacket through which water, steam or oil may be fed. The inside of the said wall is preferably maintained at a temperature of at least 130° C. and especially at least 140° C.

Preferably the drying zone has an evaporation rate of 3 to 25, and especially 5 to 20 kg of water per $m^2$ of heat surface per hour.

The cooling zone is preferably defined by a cylindrical wall. Where the process is continuous, the apparatus is suitably arranged such that the drying zone and cooling zone are substantially horizontally aligned to facilitate efficient drying, cooling and transport of the material through the drying and cooling zones in a generally horizontal direction.

Suitably the drying zone and preferably the cooling zone have agitation means therein which agitates and transports the surfactant paste and forming granules through the said zones. The agitation means preferably comprises a series of radially extending paddles and/or blades mounted on an axially mounted rotatable shaft. Desirably the paddles and/or blades are inclined in order to effect transportation.

The Spray-Dried Adjunct (b)

The spray dried adjunct comprises from 0 to 35% by weight, preferably from 0 to 20% by weight, of synthetic surfactant material based on the total weight of the adjunct. Suitable synthetic surfactant materials are described below.

The adjunct further comprises from 45 to 95% by weight, preferably from 50 to 90%, of inorganic material based on the total weight of the adjunct.

It is preferred that the inorganic material comprises carbonate, for example sodium carbonate monohydrate, and especially, sodium sesquicarbonate or Burkeite (sodium carbonate/sodium sulphate double salt). Especially preferred are crystal-growth-modified carbonate salts as described in EP 22.1 776A (Unilever), in particular, crystal-growth-modified sodium sesquicarbonate, sodium carbonate monohydrate, or Burkeite.

Sesquicarbonate is preferably formed in situ from the aqueous reaction of carbonate with acid. Organic acids such as citric acid and maleic/acrylic polymer in acid form (Sokalan (Trade Mark) CP45 from BASF), detergent sulphonic acids eg linear alkylbenzene sulphonic acid (LAS acid) or other conventional organic acids may be used to produce the sesquicarbonate. Alternatively, suitable inorganic acids may be used. The Burkeite is preferably formed in situ from the aqueous reaction of carbonate with sulphate.

The adjunct preferably further comprises a fatty acid, preferably a $C_{10}$–$C_{22}$ fatty acid. The fatty acid may be converted to the corresponding soap during the preparation of the adjunct. Typically the level of fatty acid/soap in the adjunct is up to 10% by weight, preferably from 0.5% to 6%, based on the total weight of the adjunct.

The spray-dried adjunct may further comprise up to 25% by weight, preferably 5 to 20% by weight, based on the total weight of the adjunct, of a polymer. Any polymers conventionally present in detergent products may be included. Preferred polymers include amongst others, polyvinyl pyrrolidone (PVP) and vinyl pyrrolidone copolymers, cellulosic polymers such as sodium carboxymethyl cellulose, and acrylic polymers such as Sokalan (Trade Mark) CP5 (a sodium salt of maleic/acrylic acid copolymer, available from BASF). The CP5 polymer may be produced from the corresponding acid (CP45) during the conversion of an inorganic material precursor (eg carbonate) to an inorganic material (eg sesquicarbonate).

A citrate may also be present in the spray-dried adjunct, in particular where sesquicarbonate has been produced in situ by the action of an acid upon carbonate. The spray-dried adjunct may comprise up to 25% by weight of citrate, preferably up to 20% based on the total weight of the adjunct. Preferably the citrate is sodium citrate.

The spray-dried adjunct may also contain a silicate, preferably sodium silicate, in an amount of up to 25% by weight based on the total weight of the adjunct.

Usually the adjunct comprises from 0.5 to 30% by weight of free water, preferably from 1 to 25% by weight and most preferably from 5 to 20% by weight based on the total weight of the adjunct.

The bulk density of the adjunct is preferably within the range of from 150 to 650 kg/m$^3$, more preferably from 200 to 600 kg/m$^3$.

The spray-dried adjunct may optionally further comprise small amounts of other components suitable for inclusion in a granular material via a spray-drying process. The spray-dried adjunct may be treated so that other minor ingredients, or low levels of actives, may be sprayed onto the adjunct.

The spray-dried adjunct may be produced by any suitable spray-drying process known in the art.

The spray-dried adjunct may be prepared by mixing an inorganic material precursor (eg sodium carbonate for sodium sesquicarbonate) with one or more acids (eg citric acid and/or maleic/acrylic acid). During this process one or more of the acids may be converted to the corresponding polymeric salt eg the sodium maleic/acrylic acid salt. In this way the inorganic material can be produced in-situ. Other components to be present in the adjunct (or precursors thereof) may also be included at this stage.

The mixture should be maintained at a temperature at which it is stable, eg below 80° C., prior to the addition of a suitable amount of water to form a slurry of the required viscosity.

The slurry should be maintained at a temperature such that the slurry components do not degrade. For sesquicarbonate containing slurries the temperature should typically be maintained at below 80° C.

The slurry may be spray-dried according to any suitable process. Typically the tower inlet temperature should not exceed 450° C. and the tower outlet temperature should remain within the range of from 95 to 135° C. Suitable nozzle pressures during spray-drying are in the range of 20 to 60 bar, for example 40 bar.

For the spray-drying of sesquicarbonate containing adjuncts it has been found that recirculation, supersaturation or agitation (or a combination thereof) of the slurry during spray-drying helps to achieve fast crystallisation and produce an adjunct of a suitable bulk density.

Typically the sesquicarbonate containing slurries comprise 40–60% by weight of total water in order to provide suitable properties for spray-drying.

The Granular Detergent Composition

The granular detergent composition comprises from 35 to 85% by weight of the granulate (a) (the base powder), preferably from 45 to 80% (based upon the total weight of the granular detergent composition).

Typically the granular detergent composition will comprise from 0.5 to 35% of the spray-dried adjunct (based on the total weight of the granular detergent composition), preferably from 1 to 30%, most preferably from 2 to 25% by weight.

Typically the synthetic surfactant concentration in the granular detergent composition is from 5% to 50%, preferably from 10% to 45%, most preferably from 15% to 40%.

Typically the builder concentration in the granular detergent composition is from 5 to 80%, preferably from 9% to 50%, more preferably from 15% to 40%, most preferably from 20% to 35%, by weight of the total product.

Typically the water concentration in the granular detergent composition is from 0% to 20%, preferably from 1% to 15%, most preferably from 2% to 10%.

The granulate and the spray-dried adjunct may be mixed together by any suitable means so as to produce the granular detergent composition. Typically the spray-dried adjunct is added to the granulate in a medium shear rate mixer, and the two components are mixed until a well mixed product is obtained.

The granulate and spray-dried adjunct are mixed together in suitable proportions so that the required bulk density of the granular detergent product is obtained. The bulk density of the granular detergent composition is at least 550 kg/m$^3$. It is especially preferred that the bulk density of the granular detergent composition is within the range of from 600 kg/m$^3$ to 1200 kg/m$^3$, most preferably from 650 kg/m$^3$ to 1000 kg/m$^3$, for example from 700 kg/m$^3$ to 950 kg/m$^3$.

In addition, the granular detergent composition may comprise postdosed ingredients, in addition to the granulate (base powder) and the spray dried adjunct which are the essential elements of the invention. Postdosed ingredients may suitably be present in a total amount of up to 25% (based on the total weight of the composition).

Ingredients which are normally but not exclusively postdosed, may include bleach ingredients, bleach precursor, bleach catalyst, bleach stabiliser, photobleaches, alkali metal carbonate, water-soluble crystalline or amorphous alkaline metal silicate, layered silicates, anti-redeposition agents, soil release polymers, dye transfer inhibitors, fluorescers, inorganic salts, foam control agents, foam boosters, proteolytic, lipolytic, amylitic and cellulytic enzymes, dyes, speckles, perfume, fabric conditioning compounds and mixtures thereof.

Detergent Ingredients

The granulate contains at least synthetic surfactant material and inorganic material, and, the spray dried adjunct contains at least inorganic material. The following is a description of ingredients which, as appropriate, may be included in the granulate or adjunct, or may be separately dosed (postdosed) in the final product.

By the term 'synthetic surfactant' what is meant is any non-soap surfactant. Many suitable synthetic surfactant materials are available and fully described in the literature, for example, in "Surface-Active Agents and Detergents", Volumes I and II, by Schwartz, Perry and Berch. The preferred detergent-active compounds that can be used are synthetic non-soap anionic and nonionic compounds. However, in certain circumstances cationic/amphoteric and/or zwitterionic surfactants may also be present for example in the compositions with built-in fabric softening compounds.

The granulate and the spray-dried adjunct may comprise either the same or different, but compatible, surfactants.

Suitable anionic surfactants are well-known to those skilled in the art. Examples include alkyl benzene sulphonates, primary and secondary alkyl sulphates, particularly $C_{12}$–$C_{15}$ primary alkyl sulphates (PAS); alkyl ether sulphates; olefin sulphonates; alkyl xylene sulphonates; dialkyl sulphosuccinates; and fatty acid ester sulphonates. Sodium salts are generally preferred. Suitable nonionic surfactants include the primary and secondary alcohol ethoxylates, especially the $C_8$–$C_{20}$ aliphatic alcohols ethoxylated with an average of from 1 to 20 moles ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Either anionic or nonionic surfactants may be used according to the present invention. It is also possible to have a mixture of anionic and nonionic surfactants in the granular detergent composition.

The granular detergent composition may comprise soap, preferably a $C_{10}$–$C_{22}$ soap.

Compositions according to the present invention may also contain, in addition to the detergent-active compounds, detergency builders and optionally bleaching components and other active ingredients to enhance performance and properties. The variations of phosphorus containing and non-phosphorus containing builder products have already been mentioned above. For both types of built products suitable builders are given below.

It is especially preferred that the inorganic material in the granulate and/or the spray-dried adjunct comprises a non-phosphorus containing builder or phosphorus containing builder.

Non-phosphorous containing inorganic builders that may be present include sodium carbonate, if desired, in combination with a crystallisation seed of calcium carbonate as disclosed in GB-A-1 437 950. A carbonate will clearly need to be in excess of any amount used to neutralise the anionic surfactant acid precursor. Sodium carbonates are preferred. Sodium bicarbonate may also suitably be present as a builder.

Other suitable inorganic non-phosphorous containing builders include crystalline and amorphous aluminosilicates, for example zeolites as disclosed in GB 1 473 201 (Henkel); amorphous aluminosilicates as disclosed in GB 1 473 202 (Henkel); and mixed crystalline/amorphous aluminosilicates as disclosed in GB 1 470 250 (Henkel); and layered silicates as disclosed in EP 164 514B. Inorganic phosphate builders, for example, sodium orthophosphate, pyrophosphate and tripolyphosphate, may also be present.

Aluminosilicates, include the zeolite used in most commercial particulate detergent compositions, namely zeolite A. Advantageously, however, maximum aluminium zeolite P (zeolite MAP) described and claimed in EP 384 070B (Unilever) may be used. Zeolite MAP is an alkali metal aluminosilicate of the P type having a silicon to aluminium ratio not exceeding 1.33, preferably not exceeding 1.15, and more preferably not exceeding 1.07.

It is preferred that the non-phosphorus containing builder used is a carbonate, aluminosilicate and/or citrate.

Organic non-phosphorous containing builders that may be resent include polycarboxylate polymers such as polyacrylates and acrylic/maleic copolymers; monomeric polycarboxylates such as citrates, glucomates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts. These materials are preferably present in alkali metal salt, especially sodium salt, form. This list is not intended to be exhaustive.

Suitably the builder system comprises a zeolite (for example zeolite A) and optionally an alkali metal citrate and/or a crystalline layered silicate (for example SKS-6 ex Hoechst).

Examples of phosphorous-containing inorganic detergency builders include the water-soluble salts, especially the alkali metal salts of pyrophosphates, orthophosphates, polyphosphates and phosphonates.

The phosphorus containing inorganic builder is preferably pyrophosphate or polyphosphate. Specific examples of inorganic phosphate builders include sodium and potassium tripolyphosphates, orthophosphates and hexametaphosphates.

The granulate typically comprises low levels of sodium sulphate, preferably from 0 to 5% by weight based on the total weight of the granulate, most preferably from 0 to 1% sodium sulphate.

Optional ingredients may also be included in the detergent products of the present invention, either within the granulate, the spray-dried adjunct or as a post-dosed ingredient. Typically the total amount of optional ingredients is less than 25% by weight, preferably less than 20% by weight, most preferably less than 10% by weight based on the weight of the composition.

Granular detergent compositions according to the invention may also contain a bleach system, desirably a peroxy bleach compound, for example, an inorganic persalt or organic peroxyacid, capable of yielding hydrogen peroxide in aqueous solution. The peroxy bleach compound may be used in conjunction with a bleach activator (bleach precursor) to improve bleaching action at low wash temperatures. An especially preferred bleach system comprises a peroxy bleach compound (preferably sodium percarbonate or perborate) optionally together with a bleach activator.

Powder flow of the granular product may be improved by the incorporation of a small amount of an additional powder structurant, for example, a fatty acid (or fatty acid soap), a sugar, an acrylate or acrylate/maleate polymer, or sodium silicate which is suitably present in an amount of from 1–5 wt %. This is in addition to any of these compounds which may be present in the granulate or spray-dried adjunct.

The materials that may be present in granular products of the present invention include sodium silicate; corrosion inhibitors including silicates; anti-redeposition agents such as cellulosic polymers; fluorescers; inorganic salts such as sodium sulphate, foam control agents or foam boosters as appropriate; enzymes (proteases, lipases, amylases, cellulases); dyes; coloured speckles; and fabric conditioning compounds. This list is not intended to be exhaustive. These components may be present within the granulate, spray-dried adjunct and/or post dosed to the granular product.

EXAMPLES

The present invention will now be described in more detail with reference to the following non-limiting Examples, in which parts and percentages are by weight unless otherwise stated.

Measurement of Dynamic Flow Rate (DFR)

The apparatus used consists of a cylindrical glass tube having an internal diameter of 35 mm and a length of 600 mm. The tube is securely clamped in a position such that its longitudinal axis is vertical. Its lower end is terminated by means of a smooth cone of polyvinyl chloride having an internal angle of 150 and a lower outlet orifice of diameter 22.5 mm. A first beam sensor is positioned 150 mm above the outlet, and a second beam sensor is positioned 250 mm above the first sensor.

To determine the dynamic flow-rate of a powder sample, the outlet orifice is temporarily closed, for example, by covering with a piece of card, and powder is poured through a funnel into the top of the cylinder until the powder level is about 10 cm higher than the upper sensor; a spacer between the funnel and the tube ensures that filling is uniform. The outlet is then opened and the time t (seconds) taken for the powder level to fall from the upper sensor to the lower sensor is measured electronically. The measurement is normally repeated two or three times and an average value taken. If V is the volume (ml) of the tube between the upper and lower sensors, the dynamic flow rate DFR (ml/s) is given by the following equation:

$$DFR=V/t$$

The averaging and calculation are carried out electronically and a direct read-out of the DFR value obtained. All quantities of components are in parts by weight unless stated otherwise.

Measurement of Dispenser Residues

For the purposes of the present invention, dispensing into the washing machine is assessed by means of a standard procedure using a test rig based on the main wash compartment of the dispenser drawer of the Philips (Trade Mark) AWB 126/7 washing machine. This drawer design provides an especially stringent test of dispensing characteristics especially when used under conditions of low temperature, low water pressure and low rate of water flow.

The drawer is of generally cuboidal shape and consists of a main compartment, plus a small front compartment and a separate compartment for fabric conditioner which play no part in the test. In the test, a 100 g dose of powder is placed in a heap at the front end of the main compartment of the drawer, and subjected to a controlled water fill of 5 liters at 10° C. and an inlet pressure of 50 kPa, flowing in over a period of 1 minute. The water enters through 2 mm diameter holes in a plate above the drawer: some water enters the front compartment and therefore does not reach the powder. Powder and water in principle leave the drawer at the rear end which is open.

After 1 minute the flow of water is ceased, and the powder remaining is then collected and dried at 90° C. to constant weight. The dry weight of powder recovered from the dispenser drawer, in grams, represents the weight percentage of powder not dispensed into the machine (the residue). Every result is the average of two duplicate measurements.

Example 1

Production of a Sesquicarbonate-Containing Spray-Dried Adjunct

A mixture was prepared by pre-mixing 18.1% maleic/acrylic acid (CP45 available as a 45% solution from BASF), and 9.6% citric acid, and subsequently adding 1.3% fatty acid (Pristerine 4916 available as a 50% solution from Unichema). The pre-mix was maintained at approximately 70° C. To the premix 35.1% sodium carbonate, and subsequently, 35.1% water were added to produce a slurry having a total moisture content of approximately 52.5%. The slurry was maintained below 80° C. prior to spray-drying.

The slurry was spray-dried using the following final processing conditions:

| | |
|---|---|
| Outlet Temperature | 101° C. final |
| Spray Pressure | 40 bar |
| Throughput | 11.8 tph slurry |

Composition of the Spray-Dried Adjunct

| | |
|---|---|
| Sodium sesquicarbonate $2H_2O$ | 66.0% |
| Sodium citrate $2H_2O$ | 13.1% |
| Copolymer CP5 | 15.0% |
| Soap | 2.5% |
| Free moisture (approx) | 3.5% |

Bulk density of the spray-dried adjunct=347 kg/m$^3$.

Example 2

A second spray-dried adjunct was prepared by the same method, to the following formulation:

| | |
|---|---|
| Sesquicarbonate.2aq | 58.5% |
| Sodium citrate.2aq | 10.4% |
| Copolymer CP5 | 14.5% |
| Soap | 1.5% |
| Free moisture | 15.1% |

Examples 3 to 6

Mixing of a Spray-Dried Sesquicarbonate Based Adjunct With a Mechanically Mixed Granulate A mechanically mixed granulate of the composition given in Table 1 below was mixed with various post-dosed ingredients to produce the formulation given in Table 2. To this formulation varying amounts of the sesquicarbonate adjunct of Example 2 were added in order to reach a total of 3, 6, 9 and 12% of the adjunct in the final product.

The bulk density of the formulation of Table 2 was 882 kg/m$^3$. The bulk density of the spray-dried adjunct was 397 kg/m$^3$. The bulk densities of the final products are shown in Table 3.

TABLE 1

| mechanically mixed granulate | |
|---|---|
| Sodium alkyl benzene sulphonate | 14.6% |
| Non-ionic surfactant 7EO branched | 7.7% |
| Nonionic surfactant 3EO, branched | 4.1% |
| Fatty acid | 1.9% |
| Zeolite A24 | 46.7% |
| Copolymer CP5 | 1.6% |
| Sodium carbonate | 12.4% |
| SCMC | 0.9% |
| Moisture, salts, etc. | 10.1% |

Table 2: granulate plus postdosed ingredients

TABLE 2

| granulate plus postdosed ingredients | |
|---|---|
| Mechanically mixed granulate | 85.1% |
| Antifoam granule | 2.6% |
| PVP | 0.3% |
| Sodium citrate.2aq | 5.1% |
| Sodium carbonate | 1.6% |
| Sodium bicarbonate | 2.7% |
| EDTMP | 1.3% |
| Enzymes and perfumes | 1.3% |

Table 3: bulk densities of final products

| Example | % adjunct added | BD Product kg/m$^3$ |
|---|---|---|
| Control | 0 | 882 |
| 3 | 3 | 841 |
| 4 | 6 | 823 |
| 5 | 9 | 780 |
| 6 | 12 | 762 |

Examples 7 to 9, Comparative Example A

Detergent Compositions Containing Sesquicarbonate Adjuncts

To a base powder (a mechanically mixed granulate) further ingredients were post-dosed, and a sesquicarbonate adjunct added to produce compositions (Examples 7 to 9) having the overall compositions below. To a spray dried base powder further ingredients were postdosed, and a sesquicarbonate adjunct added to produce a composition (Comparative Example A) having the overall compositions below (in weight %).

| From base powder | A | 7 | 8 | 9 |
|---|---|---|---|---|
| Sodium alkyl benzene sulphonate | 6.50 | 7.77 | 7.77 | 8.17 |
| Nonionic surfactant 7EO | 3.25 | 4.08 | 4.08 | 4.29 |
| Nonionic surfactant 3EO | 4.31 | 2.19 | 2.19 | 2.30 |
| Fatty acid | 2.16 | 1.00 | 1.0 | 1.05 |
| Zeolite A24 anhydrous | 25.43 | 25.65 | 25.65 | 27.0 |
| SCMC | 0.41 | 0.34 | 0.34 | 0.35 |
| Copolymer CP5 | 3.99 | — | 0 | — |
| Sodium carbonate | 10.04 | 2.06 | 2.06 | 2.16 |
| Sodium citrate | — | 2.65 | 2.65 | 2.79 |
| Sodium sulphate | 6.59 | — | — | — |
| Other salts etc. | 1.33 | 0.15 | 0.15 | 0.16 |
| Water | 9.13 | 4.4 | 4.14 | 4.35 |

| Post-dosed | A | 7 | 8 | 9 |
|---|---|---|---|---|
| Sodium perborate 4$H_2O$ | 15.0 | 15.2 | 15.0 | 15.79 |
| EDTMP | 0.21 | 0.13 | 0.13 | 0.14 |
| Other salts | 0.80 | 0.28 | 0.27 | 0.28 |
| TAED | 2.29 | 3.04 | 3.0 | 3.16 |
| Antifoam | 1.44 | 1.22 | 1.2 | 1.26 |
| Fluorescer | — | 0.81 | 0.8 | 0.84 |
| Enzyme | 0.29 | 0.30 | 0.29 | 0.30 |
| Perfume | 0.21 | 0.21 | 0.21 | 0.22 |
| Sodium sulphate | 6.56 | — | 9.1 | 9.58 |
| Sodium carbonate | — | — | — | 5.26 |
| Sesquicarbonate adjunct | — | 29.10 | 20.00 | 10.53 |

The sesquicarbonate adjunct of Example 2 was used in examples 7 to 9. The bulk density of the base powder was 882 kg/m$^3$.

Bulk densities and dynamic flow rates were as follows:

| Example | Bulk density (kg/m$^3$) | Dynamic flow rate (ml/s) | Dispensing at 10° C. |
|---|---|---|---|
| A | 612 | 76 | 0 |
| 7 | 622 | 149 | 2.5 |
| 8 | 722 | 142 | 3.5 |
| 9 | 817 | 137 | 3.5 |

Example 7 comprised a mechanically mixed base powder, 29.1% spray dried adjunct and also post dosed materials; it had approximately the same bulk density as the spray dried powder of Comparative Example A. However Example 7 exhibited a higher DFR and better dispensing properties than Comparative Example A. Therefore the bulk density has been modified for Example 7 (so as to be comparable to that of the lower bulk density of Comparative Example A) whilst the physical properties of Example 7 are superior to those of Comparative Example A.

Examples 8 and 9 have higher bulk densities than Example 7 due to lower levels of the spray dried adjunct being present. However the advantages with respect to the physical properties are still achieved when compared to Comparative Example A. Therefore the flexibility in bulk density modification, and the associated advantages in physical properties over for a wide range of bulk densities, is demonstrated.

Example 10

Production of a Burkeite Containing Spray Dried Adjunct

A slurry composition was prepared comprising:

| | % by weight |
|---|---|
| Water | 37.6 |
| Sodium polyacrylate*[1] | 0.4 |
| Sodium sulphate | 22 |
| Sodium carbonate | 8.2 |
| 45% sodium silicate soln. | 20.9 |
| Sodium carboxy methyl cellulose | 0.3 |
| Fatty acid*[2] | 0.5 |
| CP5 (40% soln) | 7.5 |
| Nonionic surfactant 7EO | 2.6 |

*[1]available as Sokolan PA25 (45% solution) from BASF
*[2]available as Pristerene 4917 from Unichem The slurry was spray-dried to produce a Burkeite-based adjunct of the following formulation:

| | % by weight |
|---|---|
| Burkeite ($2Na_2SO_4$—$Na_2CO_3$) | 61.5 |
| Sodium silicate | 19.1 |
| Nonionic surfactant 7EO | 5.4 |
| Soap | 6.1 |
| Sodium carboxy methyl cellulose | 0.6 |
| Sodium polyacrylate*[1] | 0.4 |
| Water | 6.9 |

The bulk density of the Burkeite spray-dried adjunct was 399 kg/m$^3$.

Examples 11 to 13, Comparative Example B

Detergent Compositions Containing Burkeite Adjunct

The Burkeite-containing adjunct of Example 10 (see previously) was added in varying amounts to a detergent powder formulation produced from a mixture of the mechanically mixed granulate (base powder) and the post-dosed ingredients used in Examples 7 to 9.

Bulk densities (in kg/m$^3$) were as follows:

Base powder 793

Postdosed ingredients (other than sodium carbonate and sodium sulphate) 850

Sodium carbonate 1013

Sodium sulphate 1529

Final formulation (without Burkeite adjunct) 892

The base powder had the formulation shown in Table 4 below. The mix of postdosed ingredients, other than the Burkeite adjunct, sodium carbonate and sodium sulphate, is shown in Table 5 below.

Table 4

Ingredients from base powder (mechanically mixed granulate)

| | |
|---|---|
| Sodium alkylbenzene sulphonate | 7.76 |
| Nonionic surfactant 7EO | 4.08 |
| Nonionic surfactant 3EO | 2.19 |
| Fatty acid | 1.00 |
| Zeolite A24 anhydrous | 25.63 |
| SCMC | 0.34 |
| Copolymer CP5 | — |
| Sodium carbonate | 2.06 |
| Sodium citrate | 2.65 |

-continued

| | |
|---|---|
| Sodium sulphate | — |
| Other salts etc. | 0.15 |
| Water | 4.4 |
| Total | 50.00 |

The base powder had a bulk density of 793 kg/m$^3$.

Table 5

Postdosed ingredients, other than the Burkeite adjunct sodium carbonate and sodium sulphate

| | |
|---|---|
| Sodium perborate $4H_2O$ | 15.21 |
| EDTMP | 0.13 |
| Other salts | 0.28 |
| TAED | 3.04 |
| Antifoam | 1.22 |
| Fluorescer | 0.81 |
| Enzyme | 0.30 |
| Perfume | 0.21 |
| Total | 21.2 |

This mixture of postdosed ingredients had a bulk density of 850 kg/m $^3$.

The full compositions had the formulations shown in Table 6 below, which also shows bulk densities, dynamic flow rates, and dispenser residues. The effect of replacing the high bulk density sulphate and carbonate with the low bulk density Burkeite-containing spray-dried adjunct on the Dynamic Flow Rate (DFR ml/s) and the dispensing properties was not significant. Therefore the flexibility of the bulk density manipulation without affecting the physical properties is demonstrated.

Table 6: full formulations and properties

| | B | 11 | 12 | 13 |
|---|---|---|---|---|
| Base powder as in Table 4 | 50 | 50 | 50 | 50 |
| Postdosed ingredients as in Table 5 | 21.2 | 21.2 | 21.2 | 21.2 |
| Sodium carbonate | 13.8 | 8.8 | — | — |
| Sodium sulphate | 15 | 10 | 10 | |
| Burkeite adjunct | — | 10 | 18.8 | 28.8 |
| Bulk density | 892 | 782 | 713 | 632 |
| DFR | 148 | 141 | 132 | 131 |
| Dispenser residues | 2 | 1 | 1 | 0 |

What is claimed is:

1. A granular detergent composition having a bulk density of at least 550 kg/m$^3$ comprising a mixture of:

(a) from 35% to 85% by weight, based on the total granular composition, of a mechanically mixed granulate, having a bulk density of from 600 kg/m$^3$ to 900 kg/m$^3$, the granulate comprising from 15 to 50% by weight of synthetic surfactant, and from 30 to 80% by weight of inorganic compound, based upon the weight of the granulate; and (b) from 0.5 to 30% by weight, based on the total granular composition, of a spray-dried adjunct having a bulk density within the range of from 150 to 600 kg/m$^3$ and comprising 0% by weight of synthetic surfactant, and from 45 to 95% by weight of inorganic builder comprising a sodium carbonate salt selected from the group consisting of sodium carbonate monohydrate, sodium sesquicarbonate and Burkeite, all weights being based upon the weight of the adjunct.

2. A detergent composition as claimed in claim 1, wherein the granulate (a) comprises from 20 to 40% by weight of synthetic surfactant.

3. A detergent composition as claimed in claim 1, wherein the granulate (a) comprises from 35 to 75% by weight of inorganic compound.

4. A detergent composition as claimed in claim 1, wherein the spray-dried adjunct (b) comprises from 50 to 90% by weight of the inorganic builder.

5. A detergent composition as claimed in claim 1, wherein the inorganic builder in the spray-dried adjunct comprises a crystal-growth-modified sodium carbonate monohydrate, sodium sesquicarbonate or Burkeite.

6. A detergent composition as claimed in claim 1, wherein the granulate (a) is present in an amount of from 45 to 80% by weight of the total granular composition.

7. A detergent composition as claimed in claim 1, wherein the spray-dried adjunct (b) is present in an amount of from 1 to 30% by weight of the total granular composition.

8. A detergent composition as claimed in claim 1, having an average bulk density within the range of from 600 to 1200 $kg/m^3$.

* * * * *